United States Patent [19]

Zacharias et al.

[11] 4,274,274

[45] Jun. 23, 1981

[54] ROLLING MILLS

[75] Inventors: Theodor Zacharias, Meerbusch; Bernhard Terdenge, Düsseldorf, both of Fed. Rep. of Germany

[73] Assignee: Kocks Technik GmbH & Co., Düsseldorf, Fed. Rep. of Germany

[21] Appl. No.: 77,317

[22] Filed: Sep. 20, 1979

[30] Foreign Application Priority Data

Oct. 16, 1978 [DE] Fed. Rep. of Germany ..... 2845051

[51] Int. Cl.[3] ..... B21B 31/10

[52] U.S. Cl. ..... 72/239

[58] Field of Search ..... 72/239, 238

[56] References Cited

U.S. PATENT DOCUMENTS

| | | | |
|---|---|---|---|
| 3,328,973 | 7/1967 | Scheib | 72/239 |
| 3,494,166 | 2/1970 | Severin et al. | 72/239 |
| 3,665,746 | 5/1972 | Eibe | 72/239 |
| 3,698,226 | 10/1972 | Eibe | 72/239 |

*Primary Examiner*—Milton S. Mehr

*Attorney, Agent, or Firm*—Buell, Blenko, Ziesenheim & Beck

[57] ABSTRACT

The frame (2) of a rolling mill has a U-shaped mounting (12) for receiving and locating rolling stands (8). A pivoted limb (12*a*) of the mounting can be swung down to form a bridge between the frame (2) and a change-over trolley (5) for the purpose of transferring the stands between the frame and the trolley by means of draw-and-thrust-rods 15.

11 Claims, 9 Drawing Figures

ROLLING MILLS

DESCRIPTION

The invention relates to a rolling mill having interchangeable stands arranged in tandem, and at least one change-over trolley which is movable parallel to the rolling axis for the purpose of conveying stands which are removed from the rolling mill, which stands are selectively insertable into mountings of a rolling mill frame or of the change-over trolley.

In a known rolling mill of this kind, the rolling mill frame is of C-shaped construction and the stands, sliding on their undersides, are inserted into the mountings of the rolling mill frame from the change-over trolley until the stands strike against a vertical stop face which at the same time forms the wall of the associated drive mechanism which is arranged in the interior of the rolling mill frame. Draw-and-thrust-rods used for inserting the stands into the mountings of the rolling mill frame and for withdrawing the stands therefrom are arranged, together with their drives, at the side of the change-over trolley remote from the rolling axis, a draw-and-thrust-rod being provided for each stand location. When viewed in the rolling direction the exterior shape of the stands is substantially square with cut-off corners. During the rolling operation, the stands are held by clamping devices which press the stands obliquely from above against the stop face of the rolling mill frame.

This known construction has the substantial disadvantage that the stands are not accessible from above, so that the stands cannot be changed by means of factory crane installations in the event of failure of the draw-and-thrust-rods. The crane installation also cannot be used in other circumstances, such as when the work-material has jammed in the rolling mill and has to be removed. In the known rolling mills, there is no space above the stands for other devices, such as devices for extracting fumes. The stands are accessible only from the operating side. However, the change-over trolley and the draw-and-thrust rods are located in this region. Even if the change-over trolley can be readily removed, the draw-and-thrust-rods and their drive remain, so that the stands are not easily accessible even from the operating side. A further disadvantage resides in the relatively large width of the known rolling mill and the considerable spatial requirements resulting therefrom. Furthermore, the slide faces, subjected to a considerable amount of wear during changing of the stands, at the same time serve to locate the stands in the rolling position, so that the stands are increasingly misaligned relative to the rolling line as the differing amount of wear on these faces increases, thus considerably impairing the rolling operation.

An object of the invention is to provide a rolling mill which does not have all the disadvantages mentioned above and which, with good accessibility, permits the stands to be changed substantially automatically and with low expense.

The present invention resides in a rolling mill having interchangeable stands arranged in tandem in mountings of a rolling mill frame, and a rolling mill drive at one side of the stands, the mill being provided with at least one change-over trolley which is movable parallel to the rolling axis at the operating side remote from the mill drive for the purpose of conveying the stands when removed from the rolling mill frame, which stands are selectively insertable into the mountings of the change-over trolley, the mountings of the rolling mill frame being of substantially U-shaped construction and open at the top and having hinged limbs which are swingable up at the operating side remote from the rolling mill drive, the hinged limbs of the mountings being usable as clamping means for the stands during the rolling operation, and being usable as bridges between the rolling mill frame and the change-over trolley during transfer of the stands between the frame and the trolley.

This means, in the first instance, that all the stands and the regions between them are freely accessible from above, so that the stands can be changed by means of a factory crane even in the event of a fault in the draw-and-thrust-rods or in their drive. It is also readily possible to remove work-material which has jammed. The stands are then additionally and directly accessible from the operating side, particularly when the hinged limbs of the mountings are swung down into their position in the same manner as when changing the stands. Furthermore, the free space above the stands is available for other devices, such as a device for extracting fumes. Furthermore, it is possible to use stands having an additional drive on their top sides, this being of importance particularly, when, for example, it is desired to use four-roll stands at the last stand locations, whilst the rolling mill is primarily constructed only for three-roll stands. A further advantage resides in the fact that the stands are clamped in a horizontal direction and are thus not clamped against the underfaces, necessarily subjected to wear, of the stands, or against the slide faces of the mountings of the rolling mill frame.

It is advisable to provide the drive side of each mounting of the rolling mill frame with at least two stop projections or stop recesses having stop faces sloping relative to the rolling axis and to provide the stands with complementary recesses or projections by means of which the stands are held in a horizontal and vertical direction in a predetermined rolling position. These sloping stop faces are subjected to virtually no wear, so that the stands are still accurately aligned relative to the rolling line even after a long period in operation.

It is advantageous for the stands to be raised from the slide surfaces on the underside by sloping stop faces after the hinged mounting limbs of the rolling mill frame have been closed. The stands then need to be raised only one or two millimeters from the slide faces of the mountings. This is sufficient to ensure that the stands are held and adjusted by the stop faces and not by the slide faces.

Furthermore, it is advisable to arrange the stop projections or stop recesses, adjusting the stands in a vertical direction, on a level with the rolling axis, since the stands are inverted about their horizontal central axes when this is required at the respective stand location by the angular offset of the rolls necessary from one stand to the adjacent stand. If the stop projections or stop recesses locating the stands in a vertical direction are then arranged on a level with the rolling axis, only one complementary recess or projection is required on the stands, whereas two would otherwise be required.

Alternatively, the stop faces can be curved and, if required, can be in the form of circular segments. The external contours of the stands themselves can also be of virtually any conceivable configuration. However, if their undersides should also be of curved configuration, it would be necessary to use sliding shoes which are mounted onto the slide surfaces of the mountings.

In an advantageous embodiment of the invention, the hinged mounting limbs of the rolling mill frame are equipped with at least one thrust member on a level with the rolling axis, the thrust member being provided with automatic coupling and releasing connections for the supply lines of the stands. In this manner, in addition to the stands being pressed in a horizontal direction against the stop faces disposed on the vertical drive-side walls of the mountings, and being located in all directions and rigidly clamped, the supply lines for the stands are at the same time connected or disconnected. Thus, there is no need to spend additional time in connecting the lines for cooling water and lubricant. It is advisable for the thrust members of the hinged mounting limbs to be secured thereto in a resilient or pivotable manner. Thus, small differenecs in dimensions or misalignments are compensated for, particularly those which result from the pivoting of the hinged mounting limbs about their fixed pivots.

The hinged mounting limbs can have a driver device for effecting disengagement of the clutches between the roll drive shafts and the drive mechanism. Thus, in the event of a fault in the draw-and-thrust-rods or in their drive or, for example, when these are not provided in a simple embodiment of the invention, the stands can be separated from the drive, subsequently to be removed upwardly from the mounting by means of a factory crane.

In accordance with a particularly advantageous embodiment of the invention, the draw-and-thrust-rods for displacing the stands are arranged therebelow on the drive side and are couplable to the stands in the region of the under sides thereof. The arrangement of the draw-and-thrust-rods on the drive side has the substantial advantage that they do not cause an obstruction on the operating side and, moreover, utilise the space below the rolling mill drive. The overall width of the rolling mill in accordance with the invention is thereby kept small, and thus the required floor area of the mill shed is also minimised in an economic manner.

The end portions of the draw-and thrust-rods can be provided with hook-like coupling elements which are engageable into, and disengageable from, recesses in the under surfaces of the stands by turning the draw-and-thrust-rods. A coupling of this kind renders it possible for the stands to be changed substantially automatically.

Finally, it is advisable for the rolling mill frame and its mountings, and the drive mechanism of the rolling mill drive, to be separate components. Stresses resulting from the clamping of the stands in the mountings are thereby prevented from affecting the drive mechanism and its bearings.

The invention is further described, by way of example, with reference to the drawings, in which.

Figure 1:
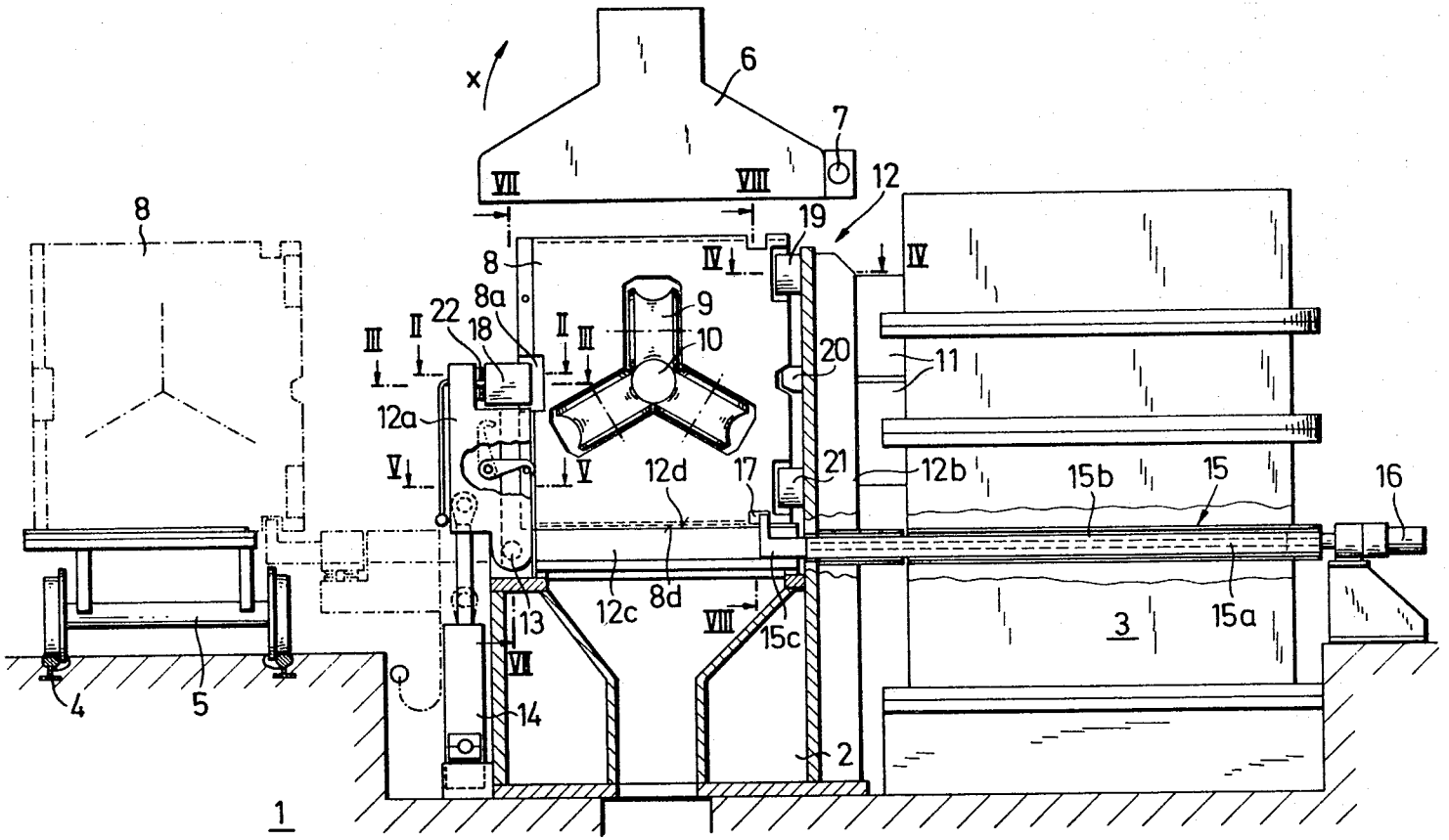
FIG. 1 is an end view of a rolling mill, partially sectioned.

Referring to FIG. 1, a rolling mill frame 2 and a drive mechanism 3, driven by a motor (not illustrated), are mounted on a bed 1. A change-over trolley 5 is movable on rails 4 provided at the operating side of the rolling mill frame 2, remote from the drive mechanism 3. A hood-like fume extractor 6 is located above the rolling mill frame 2 and can be swung away about a hinge 7 in the direction of the arrow X.

Stands 8 are arranged in tandem in the rolling mill frame 2, only the foremost stand being shown in FIG. 1. The stand 8 has three rolls 9 together forming a sizing pass 10. The rolls 9 are driven by the drive mechanism 3 by way of disengageable clutches 11. Drive shafts (not visible in FIG. 1) of the stands 8 are driven via the clutches 11, each stand 8 having only one drive shaft. The drive shafts are arranged horizontally and each at the same time forms the roll axis of the corresponding roll 9, the upper roll in FIG. 1. Since the rolls 9 are angularly offset by sixty degrees relative to one another from one stand to the next stand, the drive shaft and thus the clutch 11 are disposed above at only every other stand 8, whilst they are arranged below at each adjacent stand 8.

Each stand 8 is held in the rolling mill frame 2 in a respective U-shaped mounting 12 which is open at the top. The U-shaped mounting 12 has on its operating side remote from the rolling mill drive a hinged limb 12*a*, and a fixed limb 12*b* on the drive side. When in its non-clamped state, the stand 8 stands on a slide face 12*d* of a base part 12*c* of the mounting 12, the underface of which stand rests on the slide face 12*d*.

As is shown by dash-dot lines in FIG. 1 the hinged limb 12*a* of the mounting 12 is swingable about a horizontal pivot 13 by means of a working cylinder 14. When in its swung-out state, the hinged limb 12*a* forms a bridge between the mounting 12 of the rolling mill frame 2 and the change-over trolley 5. Thus, it is possible to push the rolling stand 8 onto the change-over trolley 5 or to pull a stand 8, located on the change-over trolley 5, into the mounting 12. This is effected by means of a draw-and-thrust-rod 15 which is disposed on the drive side in the lower part of the drive mechanism 3 and which is driven by a motor 16. The motor rotates an internal, fixed screw-threaded spindle 15*a*, so that an external tube 15*b* provided with an internal screw-thread is advanced towards the change-over trolley 5 or is retracted therefrom in dependence upon the direction of rotation. A hook 15*c* on the front end portion of the external tube 15*b* is pivotable about the longitudinal axis of the draw-and-thrust-rod 15 and is pivotable together with the external tube 15*b* and engages a recess 17 in the underside of the stand 8. The draw-and-thrust-rod 15 can be coupled to the stand 8 or uncoupled therefrom by corresponding swivelling of the hook 15*c* by rotating the draw-and-thrust-rods.

Figure 2:
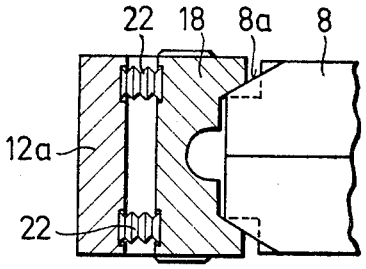
FIG. 2 is a horizontal section taken on the line II—II of FIG. 1.
Figure 4:
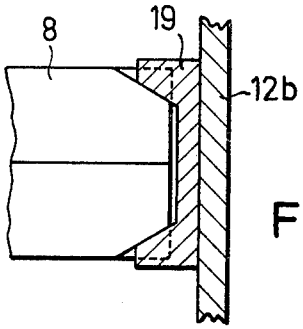
FIG. 4 is a horizontal section taken on the line IV—IV of FIG. 1.

The hinged limb 12*a* of the mounting 12 has a thrust member 18 which is located on a level with the rolling axis and which abuts against stop faces 8*a* of the stand 8 and presses the stand 8 against stop projections 19,20 and 21 of the fixed limb 12*b* of the mounting 12 under the action of the working cylinder 14. FIG. 2 shows that the stop faces 8*a* of the stand 8, and thus also the complementary counter-faces of the thrust member 18, slope oppositely relative to the rolling axis, so that the rolling stand 8 is fixed both in the direction of rolling and in the direction opposite thereto. The same applies analogously to the stop projections 19 and 21 in the region of the fixed limb 12*b* of the mounting 12, the projections 19 and 21 being shown in FIG. 1 and FIG. 4.

Cup springs 22 are shown particularly in FIG. 2 and enable the thrust member 18 to be secured resiliently to the hinged limb 12*a* of the mounting. The contact pressure of the working cylinder 14 acts horizontally by way of the hinged limb 12*a* and the resiliently secured thrust member 18. The stand 8 is not only located in the rolling direction and in the direction opposite thereto by the stop projections 19 and 21, but is also adjusted in a vertical direction, namely by the stop projection 20. The stop projection 20 also has sloping stop faces which, however, are arranged such that they adjust the stand 8 in a position in which its slide face 8*d* is slightly raised from the slide face 12*d*.

The stop projection 20 which locates the stand in the vertical direction is located at the level of the rolling axis and the stop projections 19,21 locating the stand along the rolling axis are equidistant above and below the rolling axis. This enables the same stand to be installed in an inverted position. The stop projections and recesses could be interchanged so that the projections are on the mountings and the recesses are in the stands.

Figure 3:
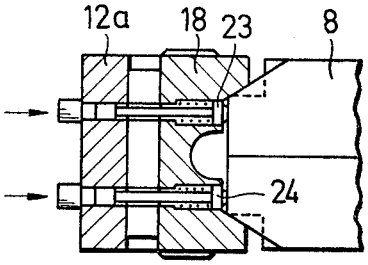
FIG. 3 is a horizontal section taken on the line III—III of FIG. 1.

FIG. 3 shows that the resiliently secured thrust member 18 is provided with two automatically coupling and releasing connections 23 and 24 through which cooling water and lubricant are fed to the stand 8.

Figure 5:
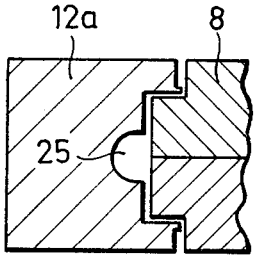
FIG. 5 is a horizontal section taken on the line V—V of FIG. 1.
Figure 6:
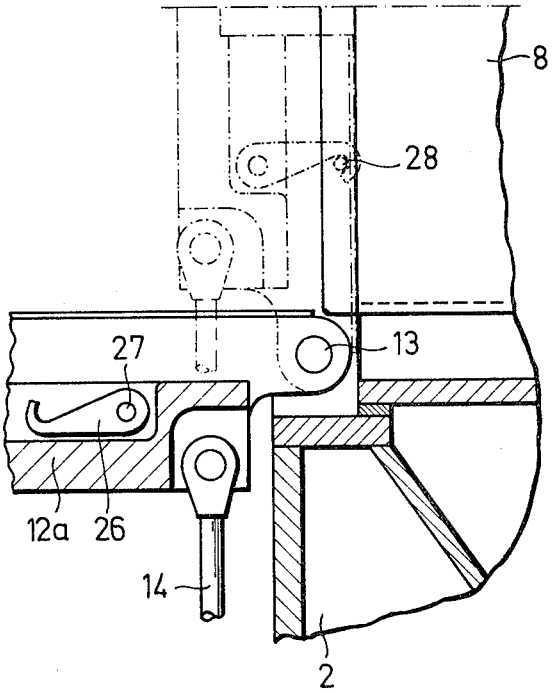
FIG. 6 is a sectional view, drawn to a larger scale, showing the hinge of a hinged member of a mounting.

FIG. 5 shows that the hinged limb 12*a* has a recess 25 which is required to accommodate the draw-and-thrust-rod 15 when the hinged limb 12*a* acts as a bridge to the change-over trolley 5. This situation is illustrated in FIG. 6. Furthermore, FIG. 6 shows a hook 26 which is pivotable about a pivot 27. The hook 26 can be engaged behind a bar 28 on the stand 8, so that, when the hinged limb 12*a* is swung down, the stand 8 is withdrawn from the mounting 12 at least by a limited amount, namely at least to an extent where the clutch 11 is disengaged and the stop projections 19, 20 and 21 are disengaged. The stand 8 can then be removed upwardly out of the mounting 12 by a factory crane installation and conveyed away after the vapour extraction hood 6 has been swung up. The hook 26 is usable both when the draw-and-thrust-rod 15 and when a factory crane are used. However, there is no need to provide the hook 26 when a draw-and-thrust-rod 15 is provided.

Figure 7:
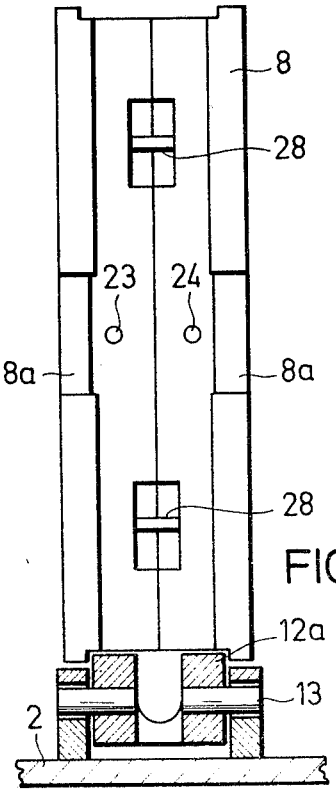
FIG. 7 is a vertical section taken on the line VII—VII of FIG. 1.

The elevation of FIG. 7 shows the end face of the stand 8 having the connections 23 and 24 for the supply lines, and the two bars 28. The upper bar 28 is required, since the stand 8 is also to be usable in a position in which it is turned through 180 degrees, i.e. inverted.

Figure 8:
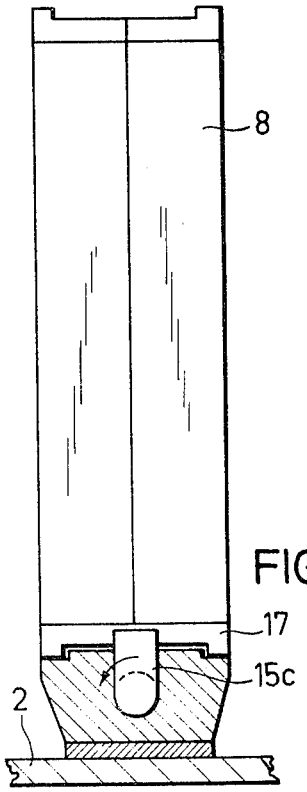
FIG. 8 is a vertical section taken on the line VIII—VIII of FIG. 1.

FIG. 8 shows the shape of the recess 17 which is in the form of a continuous groove across the entire width of the stand 8. Consequently, the driver hook 15*c* can be engaged even when the centre of the stand 8 and the centre of the draw-and-thrust-rod 15 are not accurately in register.

Figure 9:
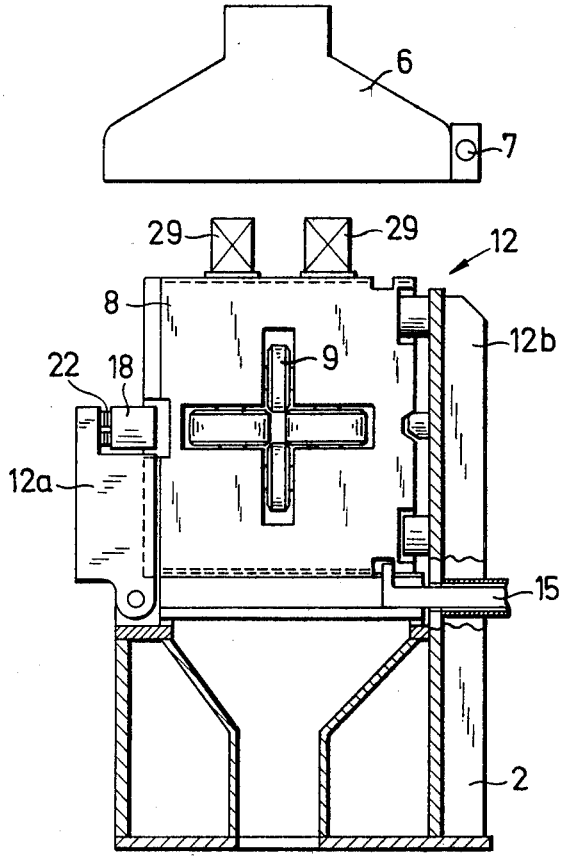
FIG. 9 is a fragmentary end view corresponding to FIG. 1, but showing a four-roll stand.

The rolling mill illustrated in FIG. 9 corresponds substantially to the rolling mill of FIG. 1. For this reason, the change-over trolley 5 and the drive mechanism 3 have been omitted for the purpose of simplifying the illustration. The essential point is to show that, alternatively, stands 8 having four rolls 9 or a different number of rolls can be fitted into the mounting 12.

By way of example, if it is desired to manufacture rectangular section tubes, these tubes are reduced or stretch-reduced with a circular cross sectional configuration in the front stands 8 and their angular cross sectional configuration is imparted to them only in the region of the last stand or stands 8. Therefore, four-roll stands are also only required at the last stand locations. However, these last stand locations are more frequently occupied by three-roll stands, since tubes having a circular cross section are more often manufactured. The mountings 12 are designed for both types of stands. As is shown in FIG. 9, four-roll stands can be used in the illustrated embodiment even when they are equipped with individual motors 29. Owing to the construction, which, in accordance with the invention, is open at the top, it is possible to use these individual motors 29 or other drive elements.

We claim:

1. A rolling mill having interchangeable stands arranged in tandem in mountings of a rolling mill frame, and a rolling mill drive at one side of the stands, the mill being provided with at least one change-over trolley which is movable parallel to the rolling axis at the operating side remote from the mill drive for the purpose of conveying the stands when removed from the rolling mill frame, which stands are selectively insertable into the mountings of the rolling mill frame or in mountings of the change-over trolley, the mountings of the rolling mill frame being of substantially U-shaped construction and open at the top and having hinged limbs which are swingable up at the operating side remote from the rolling mill drive, the hinged limbs of the mountings being usable as clamping means for the stands during the rolling operation, and being usable as bridges between the rolling mill frame and the change-over trolley during transfer of the stands between the frame and the trolley.

2. A rolling mill as claimed in claim 1, in which the drive side of each mounting of the rolling mill frame has at least two stop projections or stop recesses having stop faces oppositely inclined relative to the rolling axis, and the stands have complementary recesses or projections by means of which the stands are held in a horizontal and vertical direction in a predetermined rolling position.

3. A rolling mill as claimed in claim 2, in which the stands are raised from slide surfaces on the mountings by the sloping stop faces after the hinged mounting limbs of the rolling mill frame have been closed.

4. A rolling mill as claimed in claim 2 or 3, in which the stop projections or stop recesses locating the stands in a vertical direction are arranged on a level with the rolling axis.

5. A rolling mill as claimed in either of claims 2 or 3, in which the stop faces are curved.

6. A rolling mill as claimed in claims 2 or 3, in which the hinged mounting limbs of the rolling mill frame are equipped with at least one thrust member on a level with the rolling axis, and the thrust member is provided with automatic coupling and releasing connections for supply lines to the stands.

7. A rolling mill as claimed in claim 6, in which the thrust members of the hinged mounting limbs are resiliently or pivotally secured thereto.

8. A rolling mill as claimed in claims 2 or 3 in which the hinged mounting limbs have a driver device for coupling to the stands to displace the stands and so disengage clutches between roll drive shafts and drive mechanism when the mounting limbs are swung down.

9. A rolling mill as claimed in claims 2 or 3, in which draw-and-thrust-rods for displacing the stand are arranged therebelow on the drive side and are couplable to the stands in the region of their undersides.

10. A rolling mill as claimed in claim 9, in which the end portions of the draw-and-thrust-rods have hook-like coupling elements which are engageable into and disengageable from, recesses in the undersurfaces of the stands by rotating the draw-and-thrust-rods.

11. A rolling mill as claimed in claims 2 or 3, in which the rolling mill frame with its mountings and the drive mechanism of the rolling mill drive, are separate components.

* * * * *